C5192 OR 4,548,643

United States Patent [19]

Betts

[11] Patent Number: 4,548,643

[45] Date of Patent: Oct. 22, 1985

[54] CORROSION RESISTANT GRAY CAST IRON GRAPHITE FLAKE ALLOYS

[75] Inventor: Bruce A. Betts, Bartlesville, Okla.

[73] Assignee: TRW Inc., Cleveland, Ohio

[21] Appl. No.: 563,583

[22] Filed: Dec. 20, 1983

[51] Int. Cl.[4] ..... C22C 37/10

[52] U.S. Cl. ..... 75/124; 75/123 CB

[58] Field of Search ..... 75/124 A, 124 E, 124 F, 75/123 CB; 148/35, 138

[56] References Cited

U.S. PATENT DOCUMENTS

| | | | |
|---|---|---|---|
| 422,403 | 3/1890 | Hadfield | 75/129 |
| 648,508 | 5/1900 | Lundin | 75/124 |
| 648,509 | 5/1900 | Lundin | 75/124 |
| 670,453 | 3/1901 | Lundin | 75/124 |
| 772,712 | 10/1904 | Friese et al. | 75/124 |
| 2,329,186 | 9/1943 | Dean et al. | 75/124 |
| 2,960,401 | 11/1960 | Buchler et al. | 75/124 |
| 2,987,394 | 6/1961 | Mueller et al. | 75/124 |
| 3,811,874 | 5/1974 | Caule et al. | 75/124 |
| 3,902,897 | 9/1975 | Sobue et al. | 75/124 |
| 3,902,930 | 9/1975 | Sata et al. | 148/31 |
| 4,000,011 | 12/1976 | Sato et al. | 148/35 |
| 4,124,413 | 11/1978 | Komatsu et al. | 148/3 |
| 4,130,448 | 12/1978 | Inoue | 148/31 |
| 4,153,017 | 5/1979 | Behnke | 123/90 |
| 4,194,906 | 3/1980 | Krantz et al. | 75/125 |
| 4,338,128 | 7/1982 | Farge et al. | 75/123 |
| 4,342,588 | 8/1982 | Sporrong et al. | 75/124 |

FOREIGN PATENT DOCUMENTS

| | | | |
|---|---|---|---|
| 2408694 | 9/1974 | Fed. Rep. of Germany | 75/124 A |
| 2719456 | 11/1978 | Fed. Rep. of Germany | 148/35 |
| 0768845 | 10/1980 | U.S.S.R. | 148/35 |
| 0981432 | 12/1982 | U.S.S.R. | 75/124 |

*Primary Examiner*—L. Dewayne Rutledge
*Assistant Examiner*—Deborah Yee
*Attorney, Agent, or Firm*—Shapiro and Shapiro

[57] ABSTRACT

Corrosion resistant gray cast iron alloys useful in downhole oil well environments and the like. The alloys are substantially lower in cost and substantially higher in tensile strength than high nickel-copper cast irons commonly used downhole in submergible pumps. The alloys contain substantial amounts of aluminum in combination with nickel, chromium, manganese, molybdenum, carbon, silicon, and iron. Copper, tin, vanadium, and boron may also be included. Both hardenable and non-hardenable alloys are provided.

3 Claims, No Drawings

CORROSION RESISTANT GRAY CAST IRON GRAPHITE FLAKE ALLOYS

This invention is concerned with gray cast iron alloys and more particularly with low cost, corrosion resistant gray cast iron alloys suitable for use in downhole environments.

BACKGROUND OF THE INVENTION

Downhole components such as the impellers, diffusers, and other parts of submergible pumps, are commonly formed of corrosion resistant, high nickel-copper gray cast iron alloys such as Ni-Resist. These alloys may comprise as much as 17.5% nickel and 7.5% copper, for example, and are quite expensive. Attempts to provide alloys with the corrosion resistance, high temperature strength, and other properties of alloys like Ni-Resist, but at lower cost, have not met with success.

SUMMARY OF THE INVENTION

This invention provides low cost, corrosion resistant gray cast iron alloys suitable as replacements for high nickel-copper alloys such as Ni-Resist in downhole environments. Advantageously, the alloys of the invention have substantially greater tensile strength than that of Ni-Resist. Moreover, the alloys of the invention can be used in as cast, annealed, or heat treated condition, dependent upon the application.

Aluminum is a principal alloying element employed in the invention. Aluminum is not usually found in cast iron because of its tendencies to cause porosity and embrittlement. However, through the use of appropriate amounts of aluminum in combination with other alloying elements in accordance with the invention, these problems have been overcome.

In one of its broader aspects, the present invention provides a corrosion resistant, gray cast iron alloy comprising, by weight, 2–9% aluminum, 1–5% nickel, 0.5–2.5% chromium, 0.25–1.5% molybdenum, 0.5–2% silicon, 0.25–1.2% manganese, 2.4–4% carbon, 0–2% copper, 0–0.75% tin, 0–0.5% vanadium, 0–0.3% boron, with the balance essentially iron.

DETAILED DESCRIPTION OF THE PREFERRED EMBODIMENTS

The most important alloying element in the alloys of the invention is aluminum. The amount of aluminum employed is from 2–9%, by weight, 3–4% being preferred for non-hardenable alloys and 3–5% for hardenable alloys. If less than 2% aluminum is employed, castings formed of the alloys of the invention may suffer from pin-hole porosity. Above 9% aluminum, excessive embrittlement, rapid decrease in tensile strength, and large increase in hardness may result. The alloys of the invention contain 0.5 to 2.5% chromium, by weight. Above about 2.5%, chromium carbides that are formed may not be redissolved into the matrix, and the alloys may not be machinable. Some reduction in corrosion resistance, and increase in embrittlement, may occur if the carbides are formed in grain boundaries.

Molybdenum is employed in the invention for improved strength at operating temperature and to provide a slight increase in hardness. A range of 0.25 to 1.5%, by weight, is suitable. Above about 1.5% there is a little improvement in the properties of the alloy, but there is a significant increase in cost.

Nickel is employed in the invention to improve corrosion resistance. It also has effects similar to molybdenum, but to a lesser degree. A range of 1 to 5%, by weight, is suitable. Above about 5% improvement in corrosion resistance is not sufficient to justify the additional cost.

Manganese is used in the invention as a strengthener, a range of 0.25 to 1.2%, by weight, being suitable. Larger amounts increase work hardening and may be detrimental to machinability.

Silicon used in the invention improves casting fluidity and, to a limited degree, improves corrosion resistance. A range of 0.5 to 2%, by weight, is suitable. The addition of more silicon can cause embrittlement and undesirable matrix formation. An increase in the carbon equivalent leads to casting defects.

Carbon is used in the range of 2.4–4%, by weight. The carbon produces flake graphite cast iron and increases fluidity. In excess of about 4% carbon, undesirable amounts of carbides of chromium (and other elements such as vanadium and boron, if employed) and an iron-aluminum-carbide complex may result.

The alloys of the invention may also contain up to 2% copper, up to 0.75% tin, up to 0.5% vanadium, and up to 0.3% boron. Copper and tin serve as pearlite stabilizers, forming a hard, strong pearlite matrix upon solidification of the alloys. Addition of copper or tin above the specified limits can cause a very hard, brittle pearlitic matrix and degradation of the flake graphite. Vanadium and boron serve as hardeners and form carbides. However, unlike chromium carbides, the carbides of vanadium and boron can be redissolved into the matrix to avoid excessive hardness (assuming that vanadium and boron percentages are not greater than those noted).

The remainder of the alloys of the invention is essentially iron (and trace amounts of other elements commonly found in gray cast irons).

Preferred non-hardenable alloys in accordance with the invention have compositions as follows, by weight:

aluminum—3–4%
nickel—1.5–2%
chromium—0.5–1%
molybdenum—0.5–1%
silicon—0.75–1%
manganese—0.4–0.6%
carbon—3.2–4% the balance being essentially iron (and the usual impurities in trace amounts).

Preferred hardenable alloys in accordance with the invention have compositions as follows, by weight:

aluminum—3–5%
nickel—1.5–2%
chromium—0.5–1%
molybdenum—0.75–1.5%
silicon—0.75–1%
manganese—0.4–0.8%
carbon—3.2–4%
copper—0.05–0.5%
tin—0–0.2%
vanadium—0–0.2%
boron—0–0.2%

The remainder of the alloys of the invention is essentially iron (and trace amounts of other elements commonly found in gray cast irons).

Alloys in accordance with the invention can be made in conventional furnaces, such as the high frequency induction furnaces, cupola furnaces, etc. conventionally employed in the manufacture of cast iron. Steel scrap, carbon (graphite powder), and pig iron are charged into the furnace in the usual manner and are heated until molten. The molten metal, at about 2550° to 2600° F., is then skimmed to remove slag. Alloying additions, including ferrochromium, nickel, ferromanganese, ferromolybdenum, ferrovanadium, ferroboron, copper, and ferrosilicon are then added (assuming alloys containing all of these constituents), with the ferrosilicon being added last. The molten metal is then heated to the tap temperature of about 3100° F.

Although aluminum may be added in the furnace, it is preferably placed in a preheated ladle covered with a small amount of steel scrap to retard floatation, and the 3100° F. molten metal is poured over the steel and aluminum. As the molten metal is being poured into the ladle, ferrosilicon is added to the molten stream as a post innoculation treatment. A quick stir with a carbon rod ensures good mixing of the aluminum. A covered ladle is preferred to reduce cooling of the metal and to retard surface oxidation. A tap temperature below about 3100° F., the molten metal is somewhat sluggish when poured, and poor mold filling, increased inclusions, and cold shunts may result. The pour from the ladle should be as fast as mold filling will allow, as the metal cools more rapidly than usual gray cast iron. Green sand molds commonly used for Ni-Resist gray cast iron work well in casting the alloys of the invention. Shake-out can occur when the metal is still hot, up to about 1500° F. Above this, some alloys may increase in hardness to a point where machining is difficult.

The corrosion resistance of alloys in accordance with the invention was tested both in downhole and laboratory controlled environments. The downhole environment contained a 26.6% brine solution at 209° F. The brine solution contained a gas fraction comprising 15% nitrogen, 35% methane, 21% carbon dioxide, and 29% hydrogen sulfide. The corrosion rate of an alloy of the invention comprising 3% aluminum, 2% nickel, 1% chromium, 0.5% molybdenum, 0.8% silicon, 0.61% manganese, 3.69% carbon, with the remainder essentially iron, was 0.06 mils per year. A Ni-Resist type 1-b alloy in comparison corroded at a rate of 1.9 mils per year.

In a laboratory test facility using an electrochemical corrosion analyzer, various alloy compositions were tested in an ASTM D1114 Substitute Sea Water and a NACE solution of 5% sodium chloride and 0.5% acetic acid. Typical corrosion rates varied from 12.6 mils per year for an alloy similar to the one above to 14.3 mils per year for the Ni-Resist in the NACE solution and 2.27 mils per year for the alloy of the invention and 2.36 mils per year for Ni-Resist in the ASTM D1114 Solution.

Mechanical properties were determined by standard ASTM tests in the as cast, annealed, and heat treated conditions. Tensile strength of the alloys of the invention varied from 35,000 lbs. per square inch to 59,000 lbs. per square inch, and hardness varied from Rockwell B-70 to C-49. The tensile strength of Ni-Resist is typically 22,500 lbs. per square inch.

Alloys in accordance with the invention can be hardened by heating to 1800° F., for example, and cooling in oil, water or air. This hardening process may be followed by a tempering process, between 200° F. and 1,000° F., for example, to increase toughness and slightly reduce hardness. The hardened alloys of the invention have substantially increased abrasion resistance, particularly desirable to improve part life in abrasive environments. The conventional gray cast iron alloys currently in use are non-hardenable.

Typical tensile strength and hardness of alloys of the invention are as follows:

| Alloy | Tensile Strength | Rockwell Hardness |
|---|---|---|
| non-hardenable | 49,000 psi as cast | C-34 |
| non-hardenable | 35,000 psi as cast | C-41 |
| non-hardenable | 41,000 psi annealed | B-84 |
| non-hardenable | 57,000 psi annealed | B-77 |
| hardenable | 54,000 psi as heated treated | C-48 |

The metallurgical microstructure of the alloys of the invention varies from an as cast pearlite to an annealed ferrite for the non-hardenable alloys. In the hardenable alloys, the structures vary from pearlite in the as cast to martensitic in the heat treated condition. Selected heat treatments may be employed to produce other structures.

The following are examples of alloys produced in accordance with the invention:

| Heat No. | Al | Ni | Cr | Mo | Si | Mn | C | Cu |
|---|---|---|---|---|---|---|---|---|
| 007 | 2.93 | 2.09 | 1.00 | 1.00 | 1.04 | 0.72 | 3.07 | 0 |
| 002 | 2.97 | 2.05 | 0.78 | 1.06 | 0.57 | 1.19 | 3.35 | 0 |
| 013 | 2.99 | 2.25 | 0.98 | 1.05 | 1.91 | 0.27 | 3.12 | 0.54 |
| 005 | 4.11 | 2.25 | 0.98 | 0.46 | 0.97 | 0.86 | 3.07 | 1.74 |
| 001 | 4.07 | 2.45 | 1.06 | 0.97 | 0.98 | 0.73 | 3.21 | 0 |
| 011 | 4.01 | 2.77 | 1.03 | 0.60 | 0.97 | 0.40 | 3.00 | 0.47 |
| 015 | 4.06 | 1.99 | 1.06 | 1.05 | 1.04 | 0.45 | 3.10 | 0.94 |
| 017 | 2.99 | 3.43 | 2.21 | 0.96 | 0.97 | 0.41 | 3.15 | 0 |
| 025 | 4.00 | 2.95 | 1.21 | 0.64 | 1.97 | 0.55 | 4.08 | 0 |
| 019 | 4.01 | 2.98 | 2.15 | 1.23 | 0.96 | 0.50 | 2.60 | 0.19 |
| 024 | 4.99 | 4.84 | 2.45 | 1.12 | 1.0 | 0.87 | 3.60 | 0 |
| 010 | 4.01 | 1.24 | 1.09 | 0.52 | 0.97 | 0.58 | 3.10 | 0.34 |
| 004 | 3.03 | 1.74 | 0.77 | 0.98 | 0.61 | 0.54 | 3.25 | 0 |
| 003 | 2.99 | 1.89 | 1.03 | 1.06 | 0.52 | 0.43 | 3.35 | 0 |
| 016 | 3.00 | 2.72 | 1.02 | 0.51 | 0.98 | 0.26 | 2.93 | 0 |
| 027A | 2.02 | 2.10 | 1.14 | 1.09 | 1.01 | 0.69 | 2.88 | 0 |
| 027B | 8.97 | 2.44 | 1.06 | 1.02 | 1.02 | 0.64 | 2.88 | 0 |

The following are hardness values for the alloys of the foregoing examples:

| Heat No. | Rockwell Hardness |
|---|---|
| 007 | B-87.3 |
| 002 | C-41.1 |
| 013 | C-40 |
| 005 | B-73.3 |
| 001 | C-34.2 |
| 011 | C-34 |
| 015 | C-43 |
| 017 | C-44 |
| 025 | C-16.5 |
| 019 | C-38 |
| 024 | C-36 |
| 010 | C-34 |
| 004 | C-48.5 |
| 003 | C-42.8 |
| 016 | C-39 |
| 027A | C-33.5 |
| 027B | C-35.8 |

In certain of the above examples, copper is an alloying element. If tin is employed as an alloying element, its effect is similar to that of copper, but, in general, less tin is required to afford the same structural change. If tin is added to the alloys of Heat Nos. 002 and 001 (as designated hereinafter by addition of a letter to the respective heat numbers), the hardness values for the alloys are as follows:

| Alloy | Tin Content | Rockwell Hardness |
|---|---|---|
| 002A | 0.10% | C-35 |
| 002B | 0.25% | C-37 |
| 002C | 0.75% | C-41 |
| 001A | 0.10% | C-38 |
| 001B | 0.25% | C-39 |
| 001C | 0.75% | C-44 |

Boron and vanadium (which act as carbide stabilizers and formers) increase the hardness very rapidly as their content increases. If boron or vanadium is added to the alloys of Heat Nos. 002 and 001 (as designated hereinafter by the addition of a letter to the respective heat numbers), the hardness values for the alloys are as follows:

| Alloy | Vanadium or Boron Content | Rockwell Hardness |
|---|---|---|
| 002D | 0.2% V | C-34 |
| 002E | 0.4% V | C-38 |
| 001D | 0.2% V | C-32 |
| 001E | 0.4% V | C-41 |
| 002F | 0.1% B | C-30 |
| 002G | 0.2% B | C-34 |
| 001F | 0.1% B | C-40 |
| 001G | 0.2% B | C-42 |

The preferred alloy content is with only small additions of tin, vanadium, or boron because in higher amounts the alloys may be too hard to machine. The tin bearing alloys can be heat treated to soften them, but the vanadium and boron bearing alloys usually stay hard even if given an annealing heat treatment, if the limits noted earlier are exceeded. There are times, however, when the unmachined casting is useful and the higher hardness is necessary. In these instances, larger percentages of tin, vanadium, or boron may be used.

The following are illustrative tensile strength values for alloys of the invention:

| Heat No. | Tensile Strength Psi |
|---|---|
| 007 | 54,298 |
| 002 | 35,609 |
| 013 | 33,840 |
| 005 | 48,928 |
| 001 | 49,040 |
| 011 | 28,100 |
| 015 | 25,260 |
| 017 | 31,380 |

The alloys of the invention have superior strength and corrosion resistance, compared to other cast iron alloys used in impeller and diffuser stages of submergible pumps, for example. They have substantial corrosion resistance in water, brine, geothermal fluids and both sour and sweet crude oil. Tensile strength is at least double that of Ni-Resist, and downhole corrosion resistance is an order of magnitude better. Hardness and abrasion resistance can be made substantially higher than Ni-Resist, providing special utility in sandy wells. Cost is calculated at substantially less than Ni-Resist (probably one-third the cost).

While preferred embodiments of the invention have been shown and described, it will be apparent to those skilled in the art that changes can be made in these embodiments without departing from the principles and spirit of the invention, the scope of which is defined in the appended claims.

I claim:

1. A low cost, corrosion resistant, high strength gray cast iron flake graphite alloy suitable for downhole use, consisting essentially of, by weight, 2–9% aluminum, 1–5% nickel, 0.5–2.5% chromium, 0.25–1.5% molybdenum, 0.5–2% silicon, 0.25–1.2% manganese, 2.4–4% carbon, 0–2% copper, 0–0.75% tin, 0–0.5% vanadium, 0–0.3% boron, and the remainder iron.

2. An alloy in accordance with claim 1, wherein, by weight, the aluminum is 3–4%, the nickel is 1.5–2%, the chromium is 0.5–1%, the molybdenum is 0.5–1%, the silicon is 0.75–1%, the manganese is 0.4–0.6%, the carbon is 3.2–4%, and the remainder is iron.

3. An alloy in accordance with claim 1, wherein, by weight, the aluminum is 3–5%, the nickel is 1.5–2%, the chromium is 0.5–1%, the molybdenum is 0.75–1.5%, the silicon is 0.75–1%, the manganese is 0.4–0.8%, the carbon is 3.2–4%, the copper is 0.05–0.5%, the tin is 0–0.2%, the vanadium is 0–0.2%, the boron is 0–0.2%, and the remainder is iron.

* * * * *